US006224437B1

(12) United States Patent
Griffith, Sr. et al.

(10) Patent No.: US 6,224,437 B1
(45) Date of Patent: May 1, 2001

(54) TROLLING MOTOR MOUNT STABILIZER

(75) Inventors: Thomas E. Griffith, Sr., Florence, MS (US); Calvin Tyler, Gadsden, AL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/539,755

(22) Filed: Mar. 31, 2000

(51) Int. Cl.[7] ..... B63H 5/125
(52) U.S. Cl. ..... 440/53; 440/6
(58) Field of Search ..... 440/53, 6, 7, 55, 440/63; 248/640–643

(56) References Cited

U.S. PATENT DOCUMENTS

| | | | | |
|---|---|---|---|---|
| 1,389,712 | | 9/1921 | Thompson et al. . | |
| 2,901,267 | | 8/1959 | Holsclaw | 280/179 |
| 3,724,790 | * | 4/1973 | Harris et al. | 248/642 |
| 3,870,258 | * | 3/1975 | Shimanckas et al. | 248/642 |
| 3,954,080 | | 5/1976 | Weaver | 115/17 |
| 3,969,786 | * | 7/1976 | Peak | 16/86 |
| 4,410,161 | * | 10/1983 | Booty | 248/642 |
| 4,634,390 | | 1/1987 | Baird | 440/63 |
| 4,685,888 | | 8/1987 | Brewer | 440/53 |
| 4,828,186 | | 5/1989 | Weiss | 248/640 |
| 4,842,239 | | 6/1989 | Kinsey et al. | 248/640 |
| 4,875,656 | | 10/1989 | Boede | 248/642 |
| 4,955,834 | | 9/1990 | Henderson et al. | 440/63 |
| 4,966,566 | | 10/1990 | Baird | 440/6 |
| 5,340,077 | | 8/1994 | Tyler | 248/642 |
| 5,607,136 | | 3/1997 | Bernloehr | 248/640 |

* cited by examiner

*Primary Examiner*—Ed Swinehart
(74) *Attorney, Agent, or Firm*—Fletcher, Yoder & Van Someren

(57) ABSTRACT

A mount assembly for a trolling motor is provided. The mount assembly includes a bracket adapted to support the trolling motor. A pivoting member, such as a link or an arm, has a first end pivotally coupled to the bracket. The pivoting member is also pivotally coupled to an abutment adjacent a boat deck or gunwale at its second end. A support member is rigidly affixed to a surface of the bracket such that the support member sustains the overhung load of the trolling motor while it is in the stowed position on the boat deck or gunwale. The support member is flat and unobtrusive when the motor is in its run position.

20 Claims, 3 Drawing Sheets

TROLLING MOTOR MOUNT STABILIZER

BACKGROUND OF THE INVENTION

1. Field Of The Invention

The present invention relates generally to trolling motors. More specifically the present invention relates to a stabilizer used in conjunction with a trolling motor mount to minimize movement of the trolling motor when not in use.

2. Description Of The Related Art

Trolling motors are typically light weight electric propulsion units used to propel fishing boats. Because of the small size and quiet operation of such motors, they are often used to propel the boat into remote and shallow regions of a body of water. The motors may be operated and controlled without diverting the user from fishing in many instances. However, trolling motors are not typically used as the primary source of propulsion on a boat. Rather, when it is desirous to travel significant distances in the boat, the trolling motor is typically placed in stowed position on the deck or gunwale of the boat while the primary motor propels the boat. Likewise, when the boat is being towed on a trailer, the trolling motor may be placed in a stowed position to keep the motor from projecting outward of the boat and thus causing a hazard during transit and potentially damaging the motor.

Numerous mounts and assemblies have been employed to facilitate the transition of the trolling motor from the motor's operable position to its stowed position. Most assemblies involve some sort of pivoting arrangement including at least one link or arm which is pivotally attached to the deck or gunwale of the boat at one end, and pivotally attached to a motor bracket at the other end. In such an assembly the arm pivots about the connection to the deck and swings the motor out of the water and onto the deck or gunwale. Some mechanisms use multiple links or arms to take advantage of various geometrical arrangements. By varying the spatial arrangement of links and pivotal connections, a trolling motor can be moved from an operable position which is perpendicular to the boat's deck, to a stowed position wherein the trolling motor is adjacent to and substantially parallel with the deck, while also facilitating a certain amount of lateral displacement of the motor. The lateral displacement of the motor allows the entire trolling motor to be brought on deck such that no components are left protruding outside the perimeter of the boat.

In such assemblies, as described above, a mechanical stop is often employed to keep the motor from over-rotating and thus coming into direct contact with the deck in the stowed position. If the motor were allowed to rest directly on the deck, the motor would be highly susceptible to shock loads during transit, either across a body of water, or in tow. Shock loads have been known to cause significant damage to the trolling motors as well as to the mounting brackets and associated hardware. Thus, mechanical stops are used in an attempt to raise the trolling motor a short distance off of the deck and to minimize shock loading.

Mechanical stops have been designed to abut the link or arm of such trolling motor mounts in an area close to a pivot point of the link. Such a design, while reducing direct shock load, may still allow bouncing due to the cantilever created beyond the location of the stop. Another result of placing the stop at such a location is that the cantilever produced by the overhung load of the motor places a large moment on the stop. This moment creates significant stress, fatigue and wear on the stop and associated components. Ultimately, such conditions may cause the stop to fail prematurely.

One way of providing a stop while reducing the cantilevered effect of the motor, is to change the location of the stop, or support, such that the stress and load induced by the moment is alleviated. In other words, the stop or support should be moved closer to the actual load imposed by the trolling motor and further from the pivoting connection. There have been various attempts to accomplish this. Some designs have placed a stop or support directly on the link itself. Others have placed the support further out toward the end of the link.

One design which attempts to move the support further from the pivot point, does so by attaching the support to the pivotal connection between the link and the motor bracket. While such a design changes the moment and load experienced by the link, it also requires disassembly of the pivoting connection at the motor bracket. Such a design does not necessarily assure a rigid and stable support since it is integrated with a pivotal connection. This type of design also assumes an existing mount assembly designed to spatially accommodate a new component at the pivoting connection. Thus, not all brackets and mounting assemblies may be able to accommodate such support without greater additional, and possibly significant alterations and modifications to existing structures and components.

There is, therefore, a need in the art for a simple and effective stop or support, which will simultaneously reduce the shock load experienced by a trolling motor while in stowed position during transit and also reduce the stress and fatigue experienced by the support. Such a support should include various characteristics and advantages such as, for example, sturdiness, stability, corrosion resistance, simplicity of installation, and applicability to existing designs.

SUMMARY OF THE INVENTION

The invention provides a trolling motor mount stabilizer designed to respond to these needs. In accordance with one aspect of the invention a mount assembly for a trolling motor is provided. The mount assembly includes a bracket adapted to support the trolling motor. A pivoting member, such as a link or an arm, has a first end pivotally coupled to the bracket. The pivoting member is also pivotally coupled to an abutment adjacent a boat deck or gunwale at its second end. A support member is rigidly affixed to a surface of the bracket such that the support member sustains the overhung load of the trolling motor while it is in the stowed position on the boat deck or gunwale.

The support member is contemplated to be a substantially planar element which extends a distance from the bracket, wherein the load experienced by the support member is substantially evenly distributed across a region of the boat deck or gunwale through an edge of the support member. The support member is fastened to the motor bracket by fasteners such as threaded bolts or screws. The fasteners may be threaded directly into the bracket, or pass through the bracket and secured by a mating nut.

In accordance with another aspect of the invention, a trolling motor mount stabilizing kit is provided for installation on a motor bracket of an existing and previously assembled motor mount assembly. The kit includes a substantially planar member adapted to be rigidly and directly mounted to a surface of the motor bracket. The support is to be mounted such that the planar member extends a distance from the motor bracket and substantially parallel with the mounting surface. Fasteners are provided for rigidly mounting the planar member to the motor bracket. A soft resilient member adapted to be affixed to the distal end of the planar support member is also provided for cushioning or absorbing shock of the mount assembly. After implementation of the kit, the planar member serves to sustain an overhung load of the trolling motor while in a stowed position.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
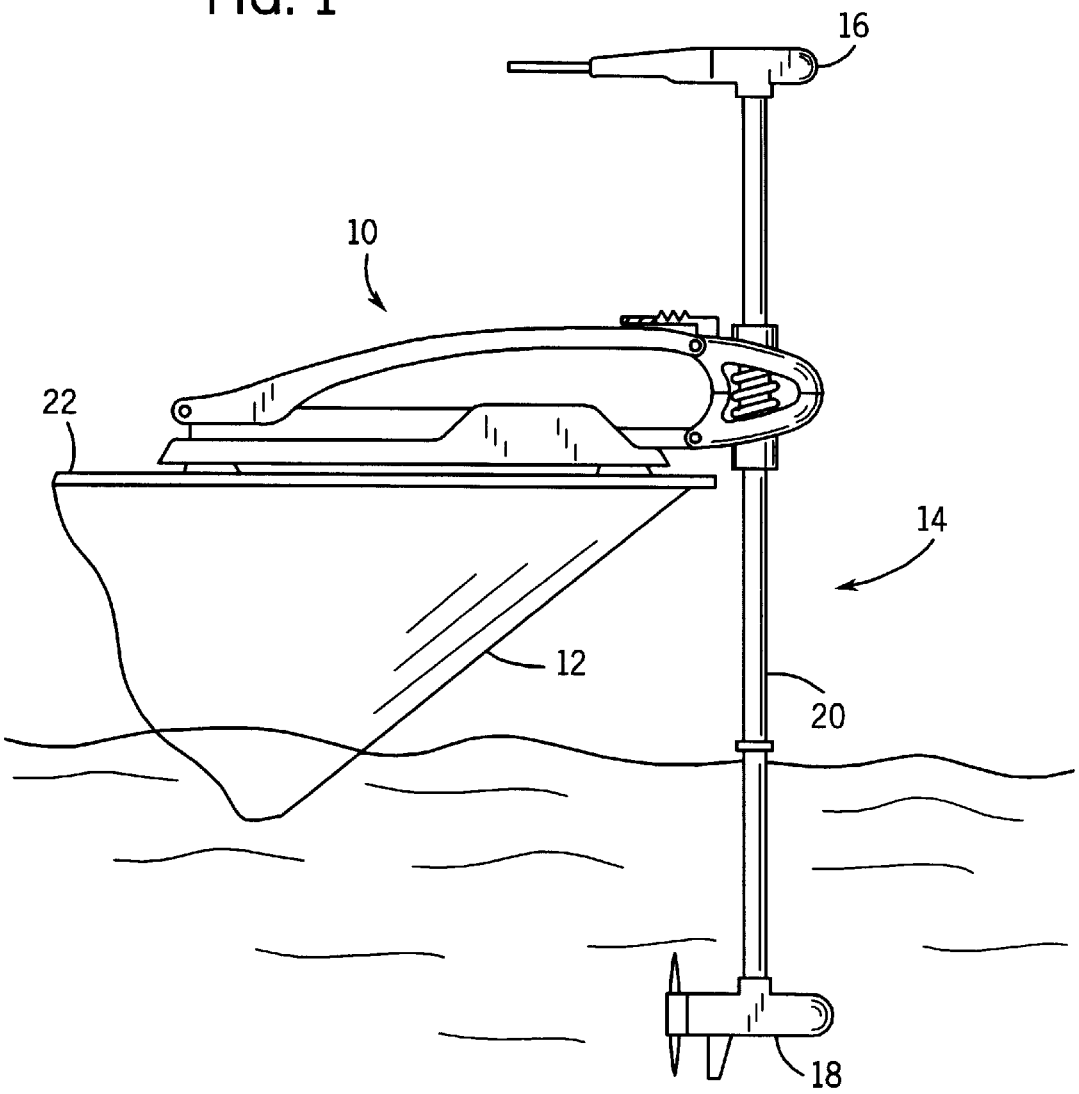
FIG. 1 is an elevational view of the bow of a boat with a trolling motor mounted according to an embodiment of the present invention.

Turning now to the drawings and referring first to FIG. 1, a mount assembly 10 on a boat 12 is adapted for a supporting a trolling motor 14. The trolling motor 14 is generally of a type known to those skilled in the art, and includes head section 16 and a prop section 18. Connecting the two sections is a substantially rigid tubular shaft member 20. The mount assembly 10 is affixed to the gunwale or deck 22 of the boat. FIG. 1 shows the mount assembly 10 and trolling motor 10 in an operable position, wherein the prop section 18 of the trolling motor 14 operates to quietly propel the boat 12 through a body of water. As described below, the mount assembly 10 is also used to stow the trolling motor 14 on the deck 22 of the boat when it is not in use.

Figure 2:
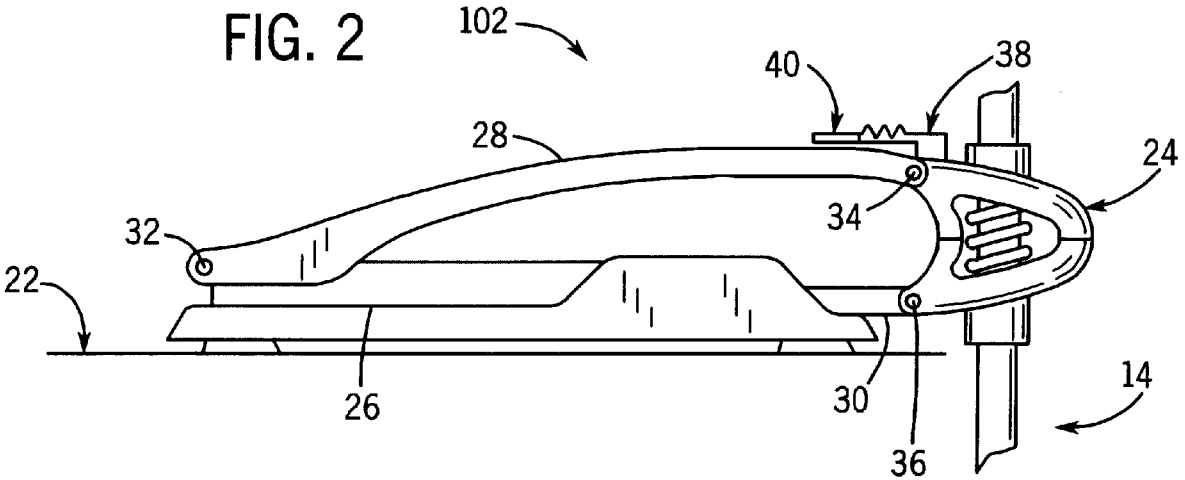
FIG. 2 is an elevational view of the mount assembly employed in FIG. 1, with the trolling motor in the operating position.
Figure 3:
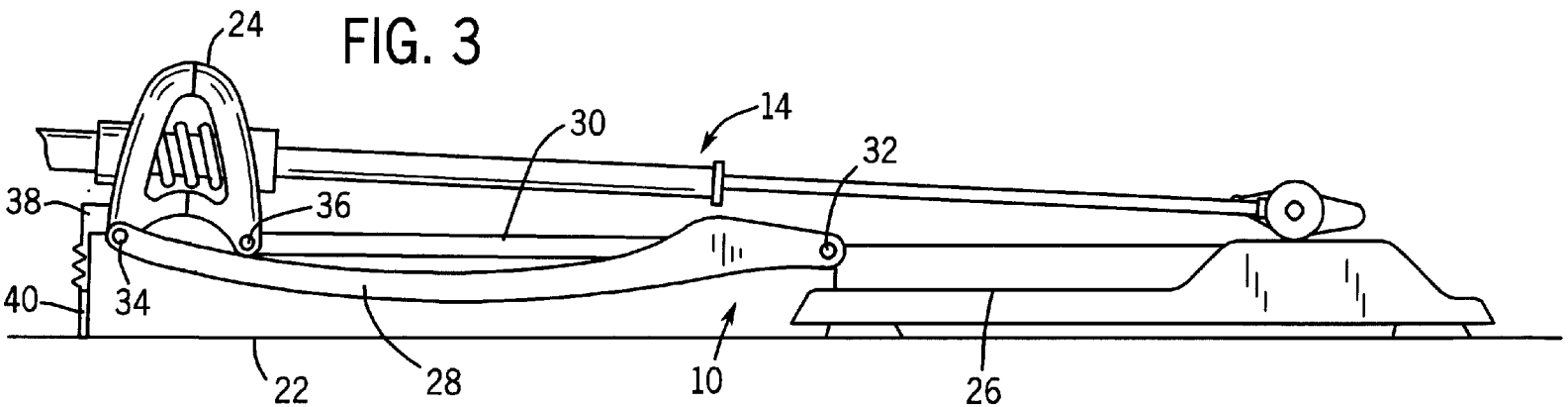
FIG. 3 is an elevational view of the mount assembly shown in FIG. 2, with the trolling motor in a stowed position.

Turning now to FIGS. 2 and 3, an enlarged view of the mount assembly 10 is shown, with FIG. 2 depicting the trolling motor in the operable position, while FIG. 3 depicts the mount assembly 10 when the trolling motor 14 is in the stowed position. The mount assembly includes a motor bracket 24 which is coupled to the shaft member 20 of the trolling motor 14. The motor bracket 24 securely holds the trolling motor 14 while allowing the trolling motor to be maneuverable and adjustable.

A base member, or an abutment 26, is attached to the boat deck 22 as a foundation for the mount assembly 10. An upper arm 28 and a lower arm 30 are attached by means of a pivotal connection 32 to the base member 26. The upper arm 28 is pivotally connected to the motor bracket 24 with a pin designated as the upper pivot pin 34. The lower arm 30, likewise, is pivotally connected to the motor bracket 24 with a pin which shall be designated the lower pivot pin 36. The geometry formed by the upper and lower arms 28 and 30, along with the motor bracket 24 and each pivotal connection 32, 34, and 36, creates a rotatable assembly for conveying the trolling motor 14 between an operable position and a stowed position. As can be seen by comparing FIGS. 2 and 3, the arms 28 and 30 rotate about the pivotal connection 32 approximately 180° between the two positions. However, because of the geometrical arrangement of the individual components, the motor bracket 24 rotates in an opposite direction approximately 90°. The assembly 10, thus allows the trolling motor 14 to be secured in a relatively vertical position during operation while, placing the trolling motor 14 in a relatively horizontal assembly for stowing purposes.

Still referring to FIGS. 2 and 3, it is noted that a stabilizer, or support member 38 is attached to the upper surface of the motor bracket 24. The support member 38 serves as a stop in the rotational path of the mount assembly 10. Thus, as the trolling motor 14 is moved from the operable position to the stowed position, the support 38 prohibits the mount assembly from over-rotating. Over-rotation could cause undue stress on related components such as the base member 26, the pivotal connection 32, the upper arm 28, and/or the boat deck 22. Also, allowing the mount assembly 10 to rotate further might cause the head section 16 of the trolling motor to contact the boat deck 22 subjecting the trolling motor 14 to significant shock loads during transit. Instead, the support 38 keeps these components out of undue stress inducing contact with one another. The support member also has a resilient cap 40 on its distal end to further reduce any shock load that might be transferred to the deck 22 or to the support member 38. It is noted that, since the support member 38 is rigidly attached to the motor bracket 24, the support member 38 maintains its geometrical relationship with the motor bracket at all times. Thus as the motor bracket 24 is rotated approximately 90° counter to the rotation of the arms 28 and 30, the support member rotates with it.

Figure 4:
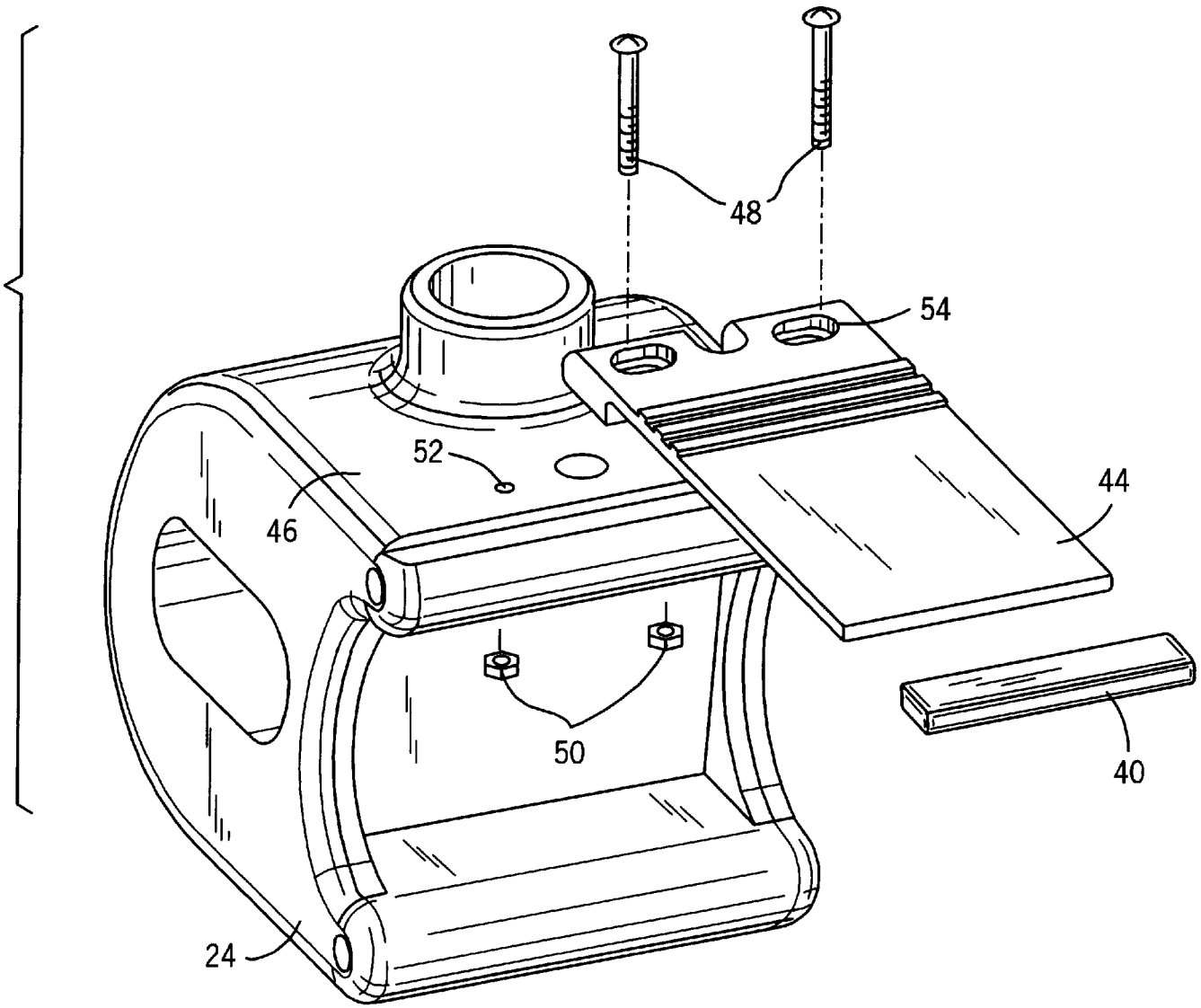
FIG. 4 is an exploded view, in perspective, of the motor bracket having the support attached according to an embodiment of the present invention.

Referring now to FIG. 4, the support member 38 is shown in greater detail in relationship to the mounting bracket 24. For purposes of orientation, upper and lower pivots, 24 and 36 respectively, are indicated and a clamping ring or collar 42, which secures the shaft member 20 of the trolling motor, is also shown. The support member 38 is formed of a substantially planar member 44. The planar member 44 is preferably made of aluminum, but may be made of stainless steel, plastic or any other corrosion resistant material having adequate strength properties. The planar member 44 is affixed to the upper surface 46 of the motor bracket 24 by means of fasteners. The fasteners are shown as threaded screws or bolts 48, and mating nuts 50. The nuts 50 are preferably locknuts, such as nylon threaded locknuts or the like. The use of locknuts helps to prevent the fasteners from loosening due to vibration during use. Again, a resilient cap 40 is placed of the distal end of the planar member 44. The resilient cap 40 serves as a cushion or a damper between the planar member 44 and the boat deck 22 upon which it rests in the stowed position. It is also noted that by using a planar member 44 the load transferred through the support 38 to the boat deck 22 is distributed to a larger region, thus reducing the effective loading experienced by the deck.

The support member 38 is thus rigidly affixed to the motor bracket 24 and has no range of motion independent of the motor bracket. The support member is also affixed in such a manner that no disassembly of the existing mount 10 or motor bracket 24 is required. Rather, simple installation is achieved with the minimal steps of locating and drilling a minimal number of holes 52 for accommodation of the new fasteners 48.

It is noted, that while the support member 38 is shown to be located on the upper surface of the support bracket 24, it is contemplated that installation may be accomplished on alternative surfaces such as one of the sides. Another variation on the disclosed embodiment would be to fasten the bolts 48 directly into a threaded hole formed in the motor bracket 24. Such a design would eliminate the use of nuts 50 and possibly allow more flexibility in selecting a region for placement of the fasteners on the motor bracket 24.

It is further noted that various modifications may be implemented to make the support member 38 adjustable relative to the distance it extends away from the motor bracket 24. For example, the planar member 44 may be supplied longer than is intended, so that the distal end may be trimmed to a specific desired length during installation prior to placing the cap 40 on the end. Also, longitudinal slots may be formed in the motor bracket to facilitated adjustability. Another means of adjustment may be to employ specially fitted washers having a non-concentric or offset aperture. Such washers or fittings might be installed in the recessed slot 54 shown on the support member 38. Such washers would effectively shift the position of the support member 38 depending on the orientation of the offset aperture.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A mount assembly for a trolling motor comprising:

a bracket adapted to support the trolling motor, the bracket being angularly translated by movement of the mount assembly between a stowed position and a deployed position;

at least one pivoting member having a first end pivotally coupled to the bracket, the at least one pivoting member being pivotable with respect to the deployed positions, and a second end pivotally coupled to an abutment adjacent a boat deck or gunwhale; and a support member rigidly affixed to a surface of the bracket wherein the support member sustains an overhung load of the trolling motor while in a stowed position, the support member being angularly translated with the bracket during movement between the stowed and deployed positions.

2. The assembly of claim 1, wherein the support member is a substantially planar element which extends a distance from the bracket and wherein the load experienced by the support member is substantially evenly distributed across a region of the boat deck or gunwale.

3. The assembly of claim 2, wherein the support member is affixed to the bracket by fasteners.

4. The assembly of claim 3, wherein the fasteners are resistant to vibrational loosening.

5. The assembly of claim 3, wherein the fasteners are threaded directly into the bracket.

6. The assembly of claim 3, wherein the fasteners include a threaded bolt which passes through both, the support member and the surface of the bracket, and a mating threaded nut coupled to the threaded bolt.

7. The assembly of claim 2, further comprising a soft resilient member affixed to the support member such that the soft resilient member is in between the support member and the boat deck or gunwale while in the stowed position.

8. The assembly of claim 2, wherein the support member is adjustable with respect to the distance which the support member extends away from the bracket.

9. The assembly of claim 2, wherein the support member is formed of aluminum.

10. The assembly of claim 2, wherein the support member is formed of stainless steel.

11. The assembly of claim 2, wherein the support member is formed of plastic.

12. The assembly of claim 1, wherein the support member is formed by a bending operation.

13. A mount assembly for a trolling motor comprising:

a bracket adapted to support the trolling motor, the bracket being angularly translated by movement of the mount assembly between a stowed position and a deployed position;

at least one pivoting member having a first end pivotally coupled to the bracket and a second end pivotally coupled to an abutment adjacent a boat deck or gun whale;

a planar support member rigidly affixed to a surface of the bracket by means of at least one threaded fastener wherein the planar support member extends a distance from the bracket transferring and substantially evenly distributing an overhung load of the trolling motor to a region of the boat deck or gunwale while in a stored position; and a soft resilient member affixed to the distal end of the planar support member.

14. A trolling motor mount stabilizing kit for installation on a motor bracket of an existing and previously assembled motor mount assembly, the motor bracket being flexibly coupled to a pivoting member so as to be rotated by movement of the pivoting member between a stowed and a deployed position, the kit comprising:

a substantially planar member adapted to be rigidly and directly mounted to a surface of the motor bracket such that the planar member extends a distance from the motor bracket and substantially parallel with the surface, the planar member being rotated with the motor bracket as the pivoting member is pivoted between the stowed position and the deployed position, wherein the planar member sustains an overhung load of the trolling motor while in a stowed position;

at least one fastener for rigidly mounting the planar member to the motor bracket; and a soft resilient member adapted to be affixed to the distal end of the planar support member.

15. The kit of claim 14, wherein the planar member is formed of aluminum.

16. The kit of claim 14, wherein the planar member is formed of stainless steel.

17. The kit of claim 14, wherein the planar member is formed of plastic.

18. The kit of claim 14, wherein the at least one fastener includes a threaded bolt and nut with mating threads.

19. The kit of claim 18, wherein the nut is a locknut resistant to vibration.

20. The kit of claim 14, wherein the fasteners are formed of a corrosion resistant material.

* * * * *